US008579106B2

(12) United States Patent
Naik et al.

(10) Patent No.: US 8,579,106 B2
(45) Date of Patent: Nov. 12, 2013

(54) PACKAGED-PRODUCT SYSTEM WITH MULTI-OPERATIONAL ACCESS CONTROL

(75) Inventors: Praful Ramachandra Naik, Honavar (IN); Avinash Shantaram Mandale, Pune (IN); Mohan Harakchand Bhandari, Pune (IN)

(73) Assignee: Bilcare Limited, Pune (IN)

( * ) Notice: Subject to any disclaimer, the term of this patent is extended or adjusted under 35 U.S.C. 154(b) by 83 days.

(21) Appl. No.: 12/993,488

(22) PCT Filed: May 20, 2009

(86) PCT No.: PCT/IN2009/000293

§ 371 (c)(1),
(2), (4) Date: Nov. 19, 2010

(87) PCT Pub. No.: WO2010/082209

PCT Pub. Date: Jul. 22, 2010

(65) Prior Publication Data

US 2011/0068041 A1 Mar. 24, 2011

(30) Foreign Application Priority Data

May 21, 2008 (IN) ..... 1006/MUM/2008

(51) Int. Cl.
*A45C 13/10* (2006.01)
*A45C 13/18* (2006.01)

(52) U.S. Cl.
USPC ..... 206/1.5; 206/531

(58) Field of Classification Search
USPC ..... 206/1.5, 528, 531, 532, 538, 539, 807; 220/23.89, 23.83
See application file for complete search history.

(56) References Cited

U.S. PATENT DOCUMENTS

| | | | | |
|---|---|---|---|---|
| 4,949,845 | A | 8/1990 | Dixon | |
| 5,082,113 | A * | 1/1992 | Romick | 206/459.1 |
| 5,109,984 | A * | 5/1992 | Romick | 206/531 |
| 5,954,202 | A | 9/1999 | Mellon | |
| 6,047,829 | A | 4/2000 | Johnstone et al. | |
| 6,338,408 | B1 * | 1/2002 | Anderson | 206/538 |
| 6,412,636 | B1 | 7/2002 | Jones et al. | |
| 7,093,736 | B2 | 8/2006 | Maietta et al. | |
| 7,419,056 | B2 * | 9/2008 | Gattefosse et al. | 206/531 |

(Continued)

FOREIGN PATENT DOCUMENTS

| | | | |
|---|---|---|---|
| EP | 1293436 | B1 | 8/2005 |
| EP | 20040754945 | B1 | 1/2008 |
| WO | WO2004/110896 | A1 | 12/2004 |

*Primary Examiner* — Luan K Bui
*Assistant Examiner* — Rafael Ortiz
(74) *Attorney, Agent, or Firm* — Pillsbury Winthrop Shaw Pittman LLP

(57) ABSTRACT

The present invention relates to a child safe packaged-product system with multi-operational access control. The invention further relates to packaged-product system that facilitates interaction with the user so as to render child safe state of the package after use. The synergistic operational combination of the said package holding provision, package fixing provision, an assembly of the package and package fixing provision operably connected by the said restrictive means results in a multi-operational access control to access the package after the completion of the child resistant activity obviating the problem of package access as a part of the child resistant activity. Further provision of the said means to remind/alert user of reengaging/repositioning the package in the child-safe state after use renders child resistant state to the package after use enhancing the effectiveness of the child resistant function of the package.

14 Claims, 4 Drawing Sheets

(56) References Cited

Figure 1:
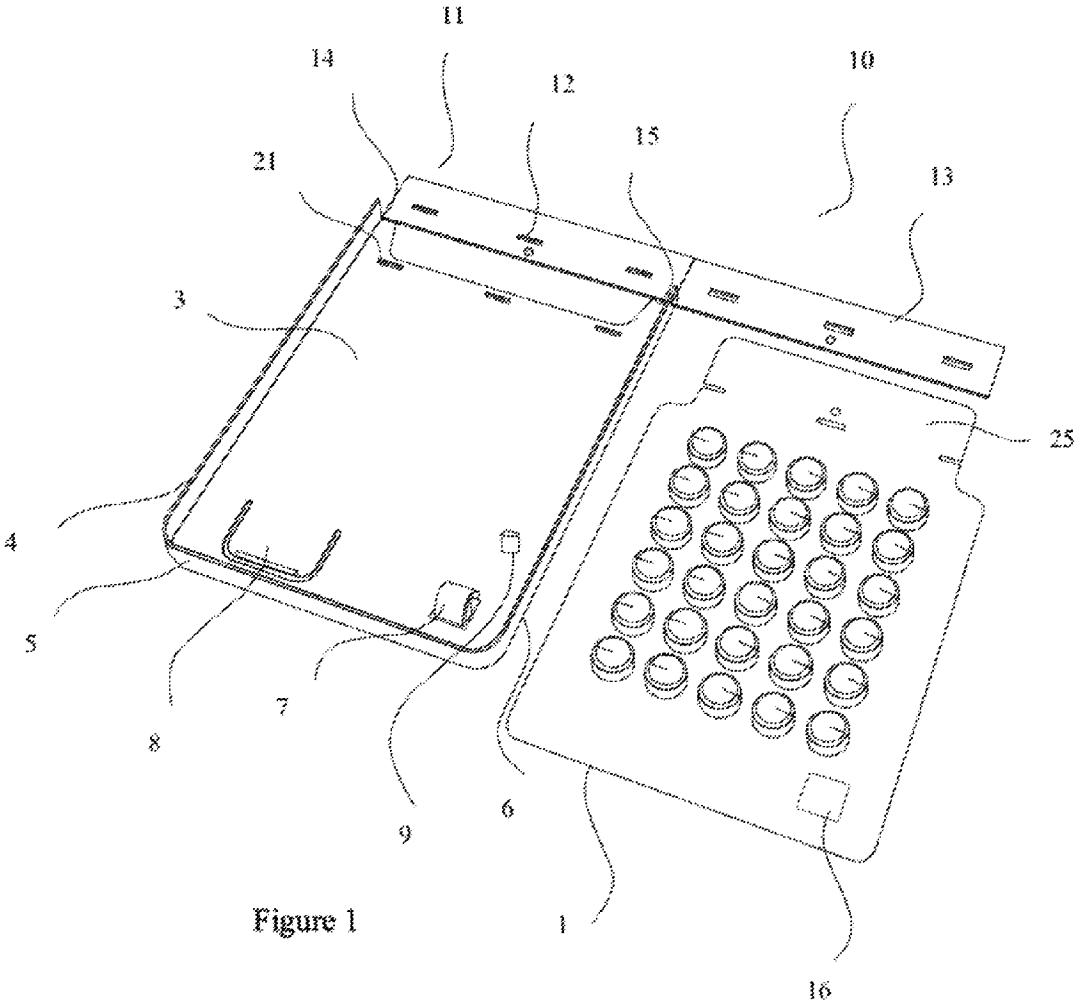

U.S. PATENT DOCUMENTS 7,942,267 B2 * 5/2011 Coe et al. ..... 206/536
8,220,636 B2 * 7/2012 Beecroft et al. ..... 206/535
2010/0264054 A1 * 10/2010 Beecroft et al. ..... 206/531
2011/0100862 A1 * 5/2011 Turkington et al. ..... 206/531
2011/0226765 A1 * 9/2011 Gelardi ..... 220/23.83

* cited by examiner

PACKAGED-PRODUCT SYSTEM WITH MULTI-OPERATIONAL ACCESS CONTROL

CROSS REFERENCE TO RELATED APPLICATIONS

This application is a national stage of International Patent Application No. PCT/IN2009/000293 filed on May 20, 2009 which claims priority to Indian Patent Application No. 1066/MUM/2008 filed May 21, 2008, the contents of which are incorporated herein in their entireties.

FIELD OF THE INVENTION

The present invention relates to a child safe packaged-product system with multi-operational access control. The invention further relates to packaged-product system that facilitates interaction with the user so as to render child safe state of the package after use. Further, the invention relates to packaged-product system provided with unique identification information.

BACKGROUND OF THE INVENTION

Products such as medicaments are primarily but not exclusively packaged in blister packs comprising one or plurality of deformable protrusions formed in a flexible sheet with a closure for each of the protrusions. An area of concern with regard to blister packs has been the uncontrolled ease with which products can be dispensed. This becomes particularly important when blister packs are handled by children and/or physically challenged. Further, establishing the authenticity and genuineness of a packaged product before use is essential as counterfeited products when consumed can cause grave harm to the patients.

Various attempts to achieve the above objectives are reported in literature.

Prior art reveals typically three design features on which child resistant packages are configured. One such design includes enclosure/carrier and package, wherein the package is removably enclosed in an enclosure having child resistant features. However in such designs, the package has to be removed from the enclosure for accessing the product resulting in separation of the package from the enclosure. Another design involves linkage of the package with the enclosure/carrier in a manner wherein the linkage is maintained even while the product is accessed. Yet another design comprises of a combination package wherein a portion of the package has restricted access zone while the other portion has a general access zone. Such a design is incapable of providing child resistant features in its entirety.

Further, some of these designs suffer from a drawback that in certain orientations such as vertically placed with the enclosure opening facing downwards, mere operation of the initial child resistant feature such as depression of a lever can result in release of the non child resistant blister package with negligible effort.

U.S. Pat. No. 7,201,274 discloses a package having a simultaneous stop, alignment, and enhanced tamper-resistant feature, wherein the package has an outer sleeve and a slide card slidably disposed within the outer sleeve. A stop panel is disposed on an inside surface of the outer sleeve and has an extension panel extending away therefrom, wherein the extension panel enhances the tamper-resistant nature of the package. A guide panel extends along a longitudinal edge of the outer sleeve and has a length equal to or greater than a combined length of the stop panel and extension panel. The guide panel being folded over the extension panel to defined a channel between an edge of the guide panel and a score line separating first and second panels of the outer sleeve.

U.S. Pat. No. 7,325,689 discloses a pharmaceutical package assembly that includes a tether having a fold-over card mating feature, and a fold-over card configured to house one or more pharmaceutical blisters, wherein the fold-over card includes a tether mating feature. One exemplary method of coupling the fold-over card to a tether includes forming a tether receiving recess in the front side of the fold-over card, folding the front side of the fold-over card adjacent to the back side of the fold-over card so that the tether receiving recess reveals an exposed portion of the fold-over card front side, and coupling the tether to the revealed portion of the card front side. Another exemplary method of coupling a fold-over card to a tether having a front side and a back side includes forming a fold-over card receiving recess in the tether such that when the front side of the tether is folded adjacent to the back side of the tether, the fold-over card receiving recess reveals an exposed portion of the tether, and coupling the fold-over card to the revealed portion of the tether.

U.S. Pat. No. 7,188,728 discloses a child-resistant senior-friendly blister card packaging that is cheap and easy to manufacture. The packaging requires a push-peel-push method for opening, which is cognitively and physically challenging for children and mentally impaired adults. Yet, competent adults can easily open the package, especially after reading instructions. More specifically, opening the package requires the user to: 1) Push through an aperture to create a pull tab; 2) Pull on the pull tab to remove a panel; and 3) Push the blister to force the contents through the blister's seal. Advantageously, the present invention is designed such that information such as instructions and product information can be easily printed directly on the packaging. Moreover, users may also record information directly on the packaging.

EP Patent 1685 034 discloses child resistant packaging system and method for making same. It is essentially a combination pack wherein the same blister pack is provided with free access portion and child resistant portion wherein access to some medications is restricted. Thus it is not a completely child resistant package system.

U.S. Pat. No. 6,679,381 discloses one hand opening child resistant blister pack container comprising top and bottom tray preferably connected by a hinge. The top and bottom trays have a tab extending therefrom. Blister pack is contained in this container.

The review of the prior art reveals following drawbacks:

- Physical dislodgement of the package from the child resistant enclosure while accessing product from the package thereby enhancing the possibility of temporarily or permanently separating the package from the child resistant enclosure
- The absence of any provision to alert and or alarm the user to replace with proper re-positioning of the package in the child resistant enclosure after use
- Incapability of providing child resistant features in entirety.
- Mere operation of the initial child resistant feature such as depression of a lever can result in release of the non child resistant blister package with negligible effort.
- Lack of dedicated and permanent pairing of the package and the tray leading to the danger of misuse of the support/tray/enclosure after of the consumption of the product in the package
- Lack of provision to remind user to reposition the package in the child resistant enclosure after use Additional openings in the package holding provisions such as tray and lack of single mould construction because of the child resistant hinging cap Isolation of the package from the child resistant enclosure while accessing product from the package resulting in the danger of separation of the package from the child resistant enclosure There is therefore a long-felt need to provide child-safe package systems to ensure that a child has to perform multiple operations to access the product from the package without dislodging the product pack from the packaging system, and easily repositioning the product pack in the packaging system, optionally equipped with user alert/alarm as a safety provision. Further it is desirable to build into the packaging system means to uniquely identify the said product package associated with the packaging system for diverse applications including anticounterfeiting, pharmaco-vigilence in clinical trials, enhancing patience compliance, etc.

SUMMARY OF THE INVENTION

The main object of the invention is to provide a child-safe packaged-product system with multi-operational access control having restrictive means for accession of the package after completion of the activities related to child resistant features thereby effectively eliminating the direct involvement of the blister package in activities related to child resistant features. It is a further object of the invention to provide a means to remind/alert user of reengaging/repositioning the package in the child-safe state after use.

Another object of the invention is to provide a packaged-product system with a dedicated/permanent pairing of the package with the child safe carrier/support/tray/enclosure so as to avoid reuse of the system after consumption of the products from the package.

Another object of the invention is to provide a uniquely identifiable package.

Yet another object of the invention is to provide a means for uniquely identifying the package to authenticate the same.

Yet another object of the invention is to provide at least two sets of identification information on the product package.

Another object of the invention is to detect and record access of the product package from the closure and communicate to the external device.

Thus one aspect of the invention provides a system comprising:

a package, package holding provision in which the package is hingably mounted, wherein the said package holding provision comprises a tray like structure, a protruding reciprocable member from base of the tray, a pressable member preferably both integrated in the said base of the tray, an optional sensing means is provided to sense the presence of the package on the base of the said tray wherein the said means is configured with power source and user interactive audio/visual/vibratory means;

a package fixing provision comprising first stripe adapted for fixing the package and a second stripe adapted to fix the package and rotatably fixed lengthwise to the said first stripe wherein the said first stripe is provided with hingable mounting provision on the edges along the length;

wherein the first stripe of the said package fixing provision is hingably connected at the distant end of the tray from the said protruding reciprocable member;

package adapted to fix between the said first and second stripe wherein the package comprises of an opening to receive the said protruding reciprocating member, optional unique identification information wherein the package is adapted to fit on the said first stripe of the said package fixing provision;

the said package fixing provision is provided with restrictive means enabling it to operably couple to the said package holding provision;

wherein the package is fixed in the said package fixing provision that is rotatable around the said end of the tray such that the package rests on the base of the tray of the package holding provision and the said restrictive means is engaged or coupled to the said tray base of the package holding provision.

wherein in operation the user has to reciprocate the said reciprocable means and simultaneously press the said pressable member to partially disengage the said package from the said package holding provision to complete child resistant activity, further the user has to perform yet another activity to decouple or disengage the assembly of package and package fixing provision that is operably coupled or engaged by the restrictive means with the said lamina of the package holding provision to access the package resulting in the technical effect of obviating the problem of package access as a apart of the child resistant activity.

In another aspect of the invention the said restrictive means is a peg with a profiled protrusions fixed or integrated with/on the said package fixing provision and operably engaged or coupled with the said lamina of the package holding provision.

In another aspect of the invention the said sensing means is provided on the surface of the said lamina in the form of a pressable switch configured with power source and audio/visual/sensory means, when the package is rotated it overlays/rests on the surface of the lamina and presses the said switch wherein upon removing the package from the said rest position at the time of consuming the product in the package, the switch is depressed resulting in providing audio/visual indication to the user so as to remind him/her of repositioning the said package on the said lamina to render child resistant state.

In another aspect of the invention a reader device is provided to identify and read the unique identification information on the said package.

In another aspect of the invention a reader means is provided to identify and read the unique identification information on the said package wherein the reader means is suitably able to detect the identification information relating to the product package and conveys the information or generates a signal in response to the information which is communicable to the external device. Suitably, the information is encoded and preferably is optical, electronic or magnetic wherein the reader means comprises of one or more reading elements arranged to correspond to the position of each set of identification information on the package for reading the at least two sets of identification information;

wherein the said reader means is adapted to read a signal from the at least one identification feature of each of the at least two sets of identification information arranged on or incorporated within different surfaces, sides or planes of the package, and wherein the reading device is configured such that it defines the spatial relationship between a first discrete area of the first set of identification information to be read and a second discrete area of the second set of identification information to be read, and determining, using the reading device, at least one characteristic of a property of the at least one identification feature of the first set of identification features, thereby obtaining a first signal, determining, using the reading device, at least one characteristic of a property of the at least one identification feature of the second set of identification features, thereby obtaining a second signal, using a processing unit to derive/form/generate at least one signature for the object, using said first and said second signals (and thereby inherently or explicitly the features' spatial relationship).

DESCRIPTION OF THE INVENTION

Features and advantages of the invention will become apparent in the following detailed description and the preferred embodiments with reference to the accompanying drawings.

FIG. 1 Schematic of the packaged-product system (Sheet 1)

Figure 2A:
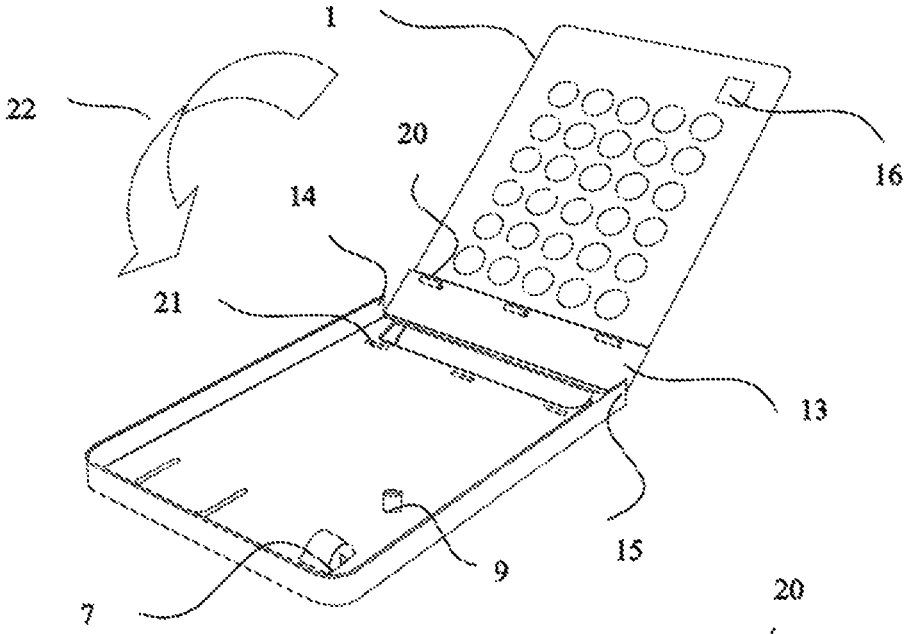
Figure 2:
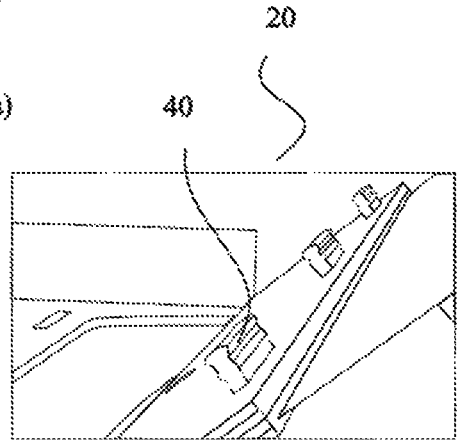

FIG. 2 Assembly of the packaged-product system (Sheet 2)

Figure 3:
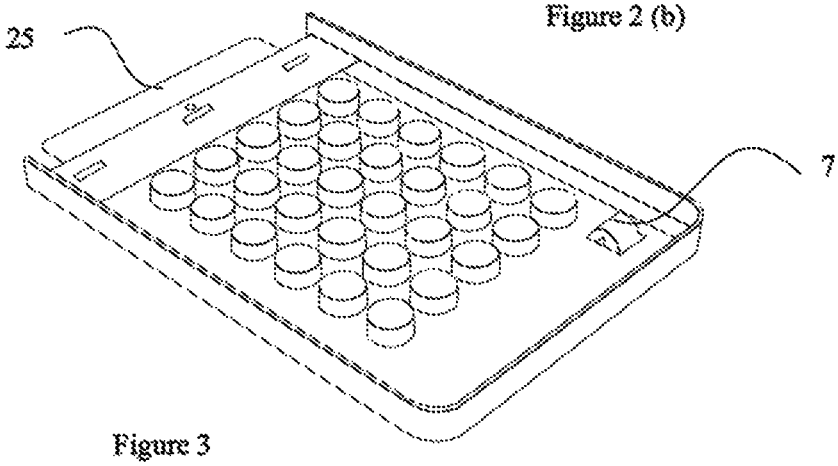

FIG. 3 Assembly view of the packaged-product system (Sheet 2)

Figure 4:
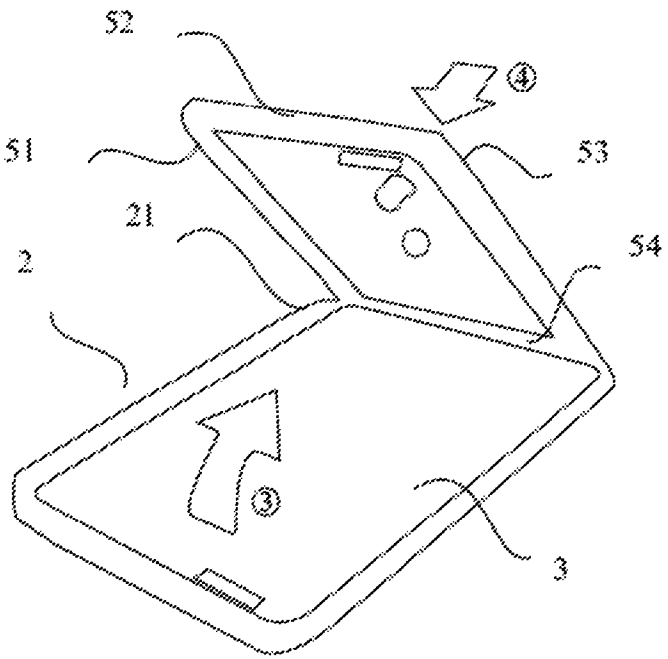
Figure 4:
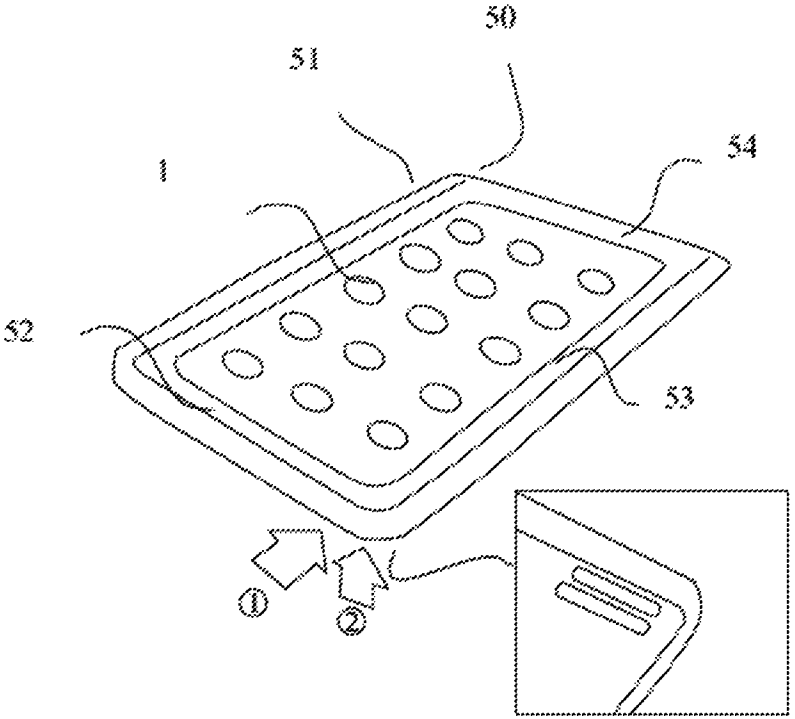

FIG. 4 Assembly view of the packaged-product system (Sheet 3)

Figure 5:
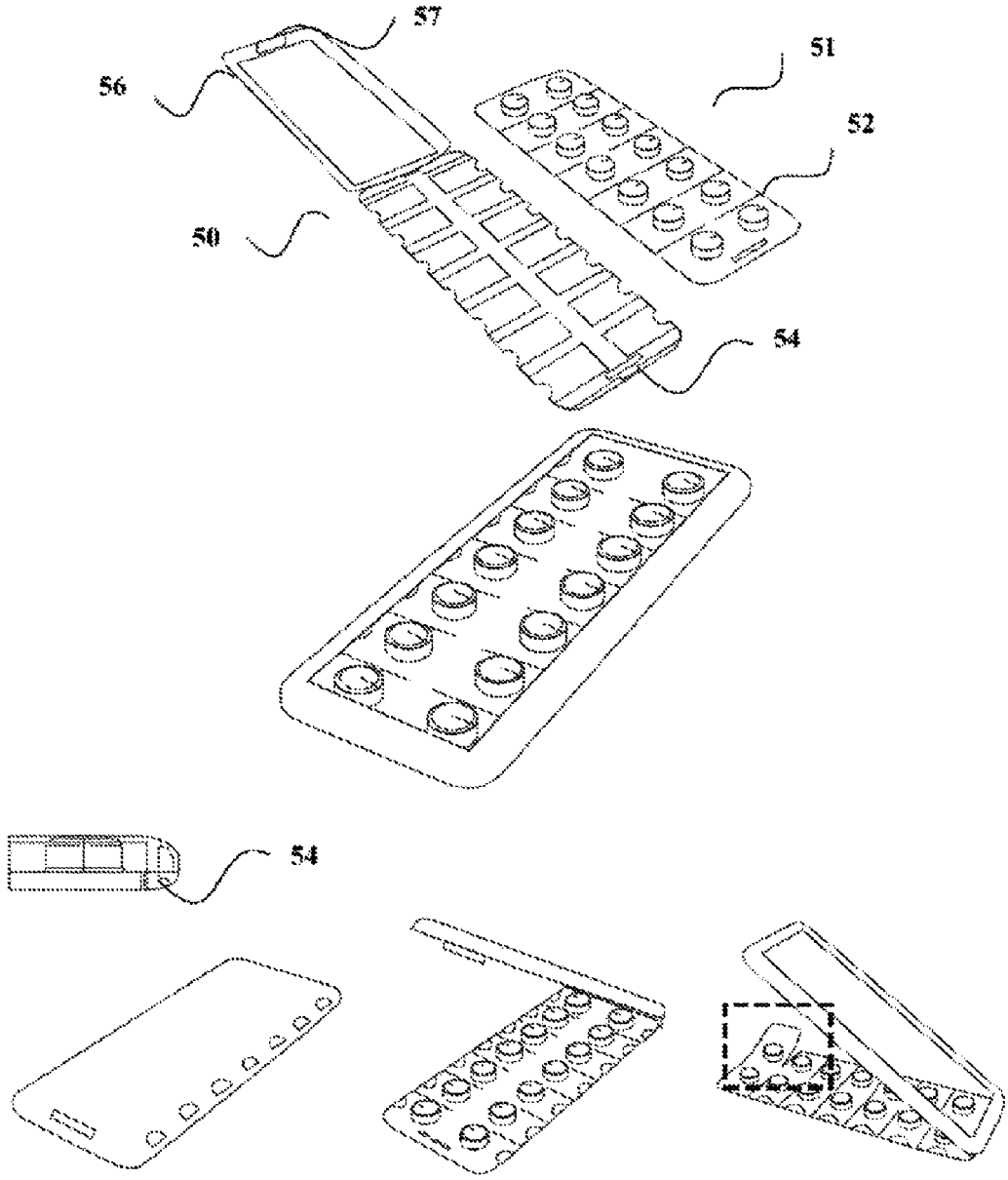

FIG. 5 Assembly view of the packaged-product system (Sheet 4)

FIG. 1 depicts one of the embodiments of the system. It comprises of a package 1 and a package holding provision 2 in the form of tray like structure in which the package is hingably mounted. The package holding provision 2 comprises a base in the form of a substantial flat lamina 3 with partial edge portions (4, 5, 6) protruding upwards to form a tray like structure. The lamina is adapted to fit a reciprocable member 7 that protrudes out of the lamina as shown in the figure and a pressable member 8 preferably both integrated in the said lamina. Further the lamina is provided with one or plurality of engaging provision/s 21. In one of the embodiments, a means is provided to sense the presence of the package on the surface of the said lamina 3 wherein the said means is configured with power source and user interactive audio/visual and sensory means. In one of the variants of this embodiment is shown in the FIG. 1 wherein a pressable switch 9 is disposed on the surface of the said lamina and configured with power source and audio/visual user interactive means (not shown). The switch 9 is pressed when the package rests on it. In another variant there can be plurality of such switched disposed on the said lamina. In another variant a proximity switch (not shown) is disposed in the vicinity of the said reciprocable member 7 wherein the said switch is configured with the power source and user interactive means.

The package holding provision 2 is operably connected to a package fixing provision 10 comprising first stripe 11 provided with slots/depressions 12 for receiving and fixing the package 1 and a second stripe 13 rotatably connected lengthwise to the said first stripe wherein the said first stripe is provided with hingable mounting provision 14, 15 on the edges along the length. In one of the embodiments the said second strip 13 is provided with a restrictive means such as pegs on the other surface facing (elaborated in the description of the FIG. 2)

As shown in the FIG. 1, the first stripe 11 of the said package fixing provision is hingably connected at the end of the said package holding provision 2 where edge portion is not protruded. The package 1 comprises of an opening 16 to receive the said protruding reciprocable member 7 of the said lamina. The package is adapted to fit on the said first stripe of the said package fixing provision and is provided with region 25 for providing unique identification information. Further the said package is provided with optional unique identification information.

FIG. 2 depicts assembly of the package with the package holding and package fixing provision wherein the package is fixed in the said package fixing provision. As a representation, one of the variants of restrictive means in the form of pegs is elaborated hereunder. The package 1 is fixed between the first and second stripes 11 and 13 wherein the stripe 13 is seen in the FIG. 2. The stripe 13 overlays the stripe 11 (the first stripe 11 is behind the stripe 13). The second stripe 13 is provided with one or plurality of pegs 20 on its surface facing the lamina as seen in the FIG. 2(*a*). The exploded view of one of the variants of the said pegs is depicted in FIG. 2(*b*). The peg is provided with of a profiled surface 40 as shown in the figure comprising one or plurality of projections that facilitates interference fit and disengagement of the peg in at least two steps wherein the peg gets partially disengaged from the provision 21 upon pressing of the said pressable member 8 of the said lamina and further force is needed to disengage the peg completely and thereby lift the package assembly to access the package from the said package holding provision. The package is rotated around the said hingable provisions 14, 15 connected to the package holding provision in the direction 22 indicated by the arrow so that the package overlays, rests on the lamina causing the said switch 9 to be pressed, engaging peg the 20 in 21 and positioning and engaging of the package opening 16 in the said reciprocable member 7.

FIG. 3 depicts the packaged-product system wherein package is positioned in the said package holding provision. As shown in the figure the said reciprocable member 7 is engaged in the package. To access the product, user has to reciprocate the said member 7 and press the pressable member 8 of the lamina to dislodge the said package. Further, user has to apply slight force to disengage the said pegs from the provision 21 so that the package rotates around the said hingable provisions. Further the package is provided with a uniquely identifiable information and/or combination of information on the region 25 that hangs out of the said package holding provision.

In the operation the package is fixed in the said package fixing provision that is rotatable around the said end of the tray such that the package overlays/rests on the surface of the lamina when rotated and presses the said switch wherein upon removing the package from the said rest position at the time of consuming the product in the package, the switch is depressed resulting in providing audio/visual indication to the user so as to remind him/her of repositioning the said package on the said lamina to render child resistant state.

FIG. 4 depicts one of the embodiments of the packaged-product system. It comprises of a package 1 and a package holding provision 2 in the form of tray like structure in which the package is hingably mounted. As depicted and described in the FIG. 1, the package holding provision 2 comprises a base in the form of a substantial flat lamina 3 with partial edge portions protruding upwards to form a tray like structure. Further, the lamina is adapted to fit a reciprocable member that protrudes out of the lamina and a pressable member preferably both integrated in the said lamina. The lamina is provided with one or plurality of engaging provision/s 21. The package holding provision 2 is operably connected to a package fixing provision 50 that is in the form of a frame like structure adapted to fit package in it. The frame like structure comprises of stripes indicated as 51, 52, 53, 54 around the edges of the package. These stripes are integrated with each other and have provision to hold the package between them. One of the stripe portion 54 has provision for receiving and fixing the package and is hingable mounted to the said lamina 3. Further the stripes on the surface facing the said lamina are provided with pegs (as depicted and described in FIG. 2) with a profiled surface comprising one or plurality of projections that facilitates interference fit and disengagement of the peg in at least two steps wherein the said lamina is provided with corresponding engagement provision for the send pegs. In operation, to access the product, user has to reciprocate the said member and press the pressable member of the lamina to dislodge the said package. Further, user has to apply slight force to disengage the said pegs from the provision provided on the said stripes around the package so that the frame like structure (comprised of stripes 51, 52, 53 and 54) of stripes along with the package rotates around the said hingable provisions as shown in the FIG. 4*b*.

One of the variants of this configuration is depicted in FIG. 5. The blister 51 is provided with perforation lines 52 and is adapted to fit on the package holding provision 50 comprising lamina 55 provided with adhesive means 56 disposed on the said lamina so as to hold/attach the package. Further, the said lamina is adapted to receive a snap at 54. The said lamina is operably connected to the frame like structure 56 comprising of stripes integrated with each other and disposed along the side of the package. The said structure 56 is provided with snap 57 that is removably received in provision 56 of the lamina. In operation, the said snap has to be pressed to unlock the hinge and access the package as shown in the figure. The stripes (of the said frame like structure 56) on the surface facing the said lamina are provided with peg/s (as depicted and described in FIG. 2) with a profiled surface comprising one or plurality of projections that facilitates interference fit and disengagement of the peg in at least two steps wherein the said lamina is provided with corresponding engagement provision for the send pegs. In operation user has to disengage the said snap 57 and further disengage the peg/s, further, the product is accessed by shearing part of the package along the said perforated lines to access the product.

One of the variants comprises of a package and a package holding provision in the form of tray like structure in which the package is hingably mounted. The package holding provision comprises a base in the form of a substantial flat lamina. The said base is adapted to fit a reciprocable member that protrudes out of the lamina and a pressable member as shown in FIG. 1. The package holding provision is operably connected to a package fixing provision that comprises of first stripe provided with slots/depressions for receiving and fixing the package and a second stripe rotatably connected lengthwise to the said first stripe wherein the said first stripe is provided with hingable mounting provision at one of the ends and other end is free to move/slide on the horizontal plane of the said base such that the said fixing provision along with the package fixed in it is slidable over the said base to access the product wherein the package is not rotated but is slided along the surface of the said base to access product from the package.

In one of the embodiments the said package is provided with hingable provisions integrated with it wherein the said hingable provision of the package is rotatably connected to the said package holding provision 2 where edge portion is not protruded. Thus instead of the package fixing provision the package with the hingable provision is mounted/connected to/on the package holding provision 2. In another variant of this embodiment, the package 1 comprises of first and second stripes 11 and 13 respectively wherein the package is fixed between them to form a separate assembly wherein the said assembled package is rotatably connected/coupled to the said package holding provision 2.

In another embodiment the said package holding and package fixing provision are made out of cardboard. In another variant of this embodiment the said package holding and package fixing provision are made out of biodegradable material. In yet another variant of this embodiment the said package holding and package fixing provisions are made out of plastic.

In another embodiment a reader means is provided to identify and read the unique identification information on the said package wherein the reader means is suitably able to detect the identification information relating to the product package and conveys the information or generates a signal in response to the information which is communicable to the external device. Suitably, the information is encoded and preferably is optical, electronic, magnetic or a combination thereof.

In yet another embodiment the said package holding provision may comprise any conventional reader means to detect the encoding information identifying the product package. The information or signal may be stored in the package holding provision.

In one of the embodiment of the package system, a uniquely identifiable information and for combination of information is provided on the package.

In yet another embodiment product package is provided with an identification tag for identifying the package for authentication. The tag comprises at least two sets of identification information, said at least two sets of identification information comprising a first set of identification information and a second set of identification information each arranged within a different surface, side or plane of the identification tag, and identification features of said first set of identification information and identification features of said second set of identification information are arranged at a fixed relative spatial position with respect to each other, said fixed spatial relationship being used for identifying the package system.

In yet another embodiment the identifiers are present in a tag on the product package wherein one identifier comprises a readable layer of randomly distributed material which is capable of encoding identification information, for example a conductive material, magnetized or magnetisable material, semiconductive particle and optically active particles; the second identifier suitably comprises optical information, for example a 1-D or 2-D bar code.

In yet another embodiment at least two sets of identification information is provided on the product package and/or package holding provision. In another variant of this embodiment unique identifying information is suitably included on the package in the form of oriented or orientable particles and may relate to for example, the manufacturer of the package or to an individual. Preferably the identification information comprises information derived from a magnetic field and/or an electric field and optionally optical or magneto-optical information. In yet another variant of this embodiment nano/micro particulate materials and/or material composites with measurable material metrics are used on the package for identification information.

In a preferred embodiment, the product package suitably comprises a substantially non-magnetic host material having pores, wherein at least some of the pores contain a substantially magnetic material which is codeable to encode identification information for identifying the product package or a unit dose package. The product package may comprise a substantially electrically-insulating host material having pores, wherein at least some of the pores contain a substantially electrically-conducting material which is codeable to encode identification information for identifying the unit dose package. Desirably, the electrically-conducting material is connectable to a voltage source.

In yet another embodiment the package system is provided with a means to detect disengagement of the package from the closure to monitor and/or record of package and for product access from the package system. In another variant of this embodiment the package system is provided with a wired/wireless communication means capable of interacting with external/remote device/s.

In another embodiment a sensing means in the form of embedded system is adapted to fit on the said package system to detect disengagement of the package from the said holding provision to monitor and/or record of package and/or product access from the package system. The said sensing means comprises of signal generating provision/s, data processing means, data logging and storing means configured with a communication means an optional communication switch, a power source, optional audio signal generating means, an oscillator (Real time clock) wherein the said signal generating means gets activated upon disengaging the said package from the package holding provision. The activation of the signal generating provision may be done by various means such as electronic, mechanical, optical, visual. In a specific embodiment, visual display and the audio signal generating means is provided to alert the user of the time and date of the products to be consumed and also provides quantitative information about the number of products in the package. As the user disengages the package from the closure a signal from the said signal generating provision is sent to the said data processing means wherein the time & date of product dispensed is logged into the data logging provision of the said data processing means. Using the optional communication feature, the user may transfer the logged data to an external device by optionally embedded the communication switch.

In one of the variants of this embodiment said logged data in the said data processing is transferred/transmitted via communication means to an external device/s with the aid of RF-wherein the said logged data to be transferred is superimposed on the RF field, generated by the RF circuit. In yet another variant of this embodiment the said logged data in the said data processing means is transferred/transmitted via communication means to the said external device/s using an IR link wherein the said logged data to be transferred is in the form of coded pulses or frequency. In yet another variant of this embodiment the said logged data in the said data processing means is transferred/transmitted via communication means to the said companion device through wired and/or any direct contact methods such as I2C, SPI, serial or parallel communication but not limited to these. In yet another variant of this embodiment the data is transferred using wireless communication means such as Bluetooth, Wi-Fi, Zeegbee, Wi-Max, GPRS, GSM, Wibree but not limited to it.

Thus it is evident from the present invention that the synergistic operational combination of the said package holding provision, package fixing provision, an assembly of the package and package fixing provision operably connected or engaged by the said restrictive means results in a multi-operational access control to access the package after the completion of the child resistant activity obviating the problem of package access as a part of the child resistant activity. Further provision of the said means to remind/alert user of reengaging/repositioning the package in the child-safe state after use renders child resistant state to the package after use enhancing the effectiveness of the child resistant function of the package.

We claim:

1. A child safe packaged-product system with multi-operational access control system comprising:

a package, a package holding provision in which the package is hingably mounted, wherein the package holding provision comprises:

a tray like structure having a base, a protruding reciprocable member from the base, a pressable member, wherein one or more of the protruding reciprocable member and the pressable member are integrated in the base, a package fixing provision having edges along a length and a width, and having a restriction enabling it to operably couple to the package holding provision comprising:

a first stripe adapted for fixing the package, and a second stripe adapted to fix the package and rotatably fixed lengthwise or widthwise to the first stripe wherein the first stripe is provided with hingable mounting provision on the edges along the length;

wherein the first stripe of the package fixing provision is hingably connected at the distal end of the tray from the protruding reciprocable member;

wherein the package is adapted to fix between the first stripe and the second stripe, wherein the package comprises of an opening to receive the protruding reciprocating member, wherein the package is adapted to fit on the first stripe of the package fixing provision;

wherein the package is fixed in the package fixing provision that is rotatable around the end of the tray such that the package rests on the base of the tray of the package holding provision and the restriction is engaged or coupled to the tray base of the package holding provision.

2. A child safe packaged-product system with multi-operational access control system as claimed in claim 1, further comprising a sensor provided on the surface of the base in the form of a pressable switch configured with power source and one or more of user interactive audio, visual, and a vibrator, wherein the package has a resting position on the surface of the base and presses the switch, wherein upon removing the package from the rest position, the switch is depressed resulting in providing one or more of audio and visual indication to a user so as to remind him/her of repositioning the package on a lamina to render a child resistant state.

3. A child safe packaged-product system with multi-operational access control system as claimed in claim 1, wherein the restriction is a peg with a profiled protrusions fixed or integrated with/on the package fixing provision and operably engaged or coupled with the lamina of the package holding provision.

4. A child safe packaged-product system with multi-operational access control system as claimed in claim 1, wherein the package comprises of hingable provisions wherein the hingable provisions are rotatably connected to the package holding provision.

5. A child safe packaged-product system with multi-operational access control system as claimed in claim 1, wherein the package comprises of first and second stripes wherein the package is fixed between the stripes to form a separate assembly wherein the assembled package is rotatably coupled to the package holding provision.

6. A child safe packaged-product system with multi-operational access control system as claimed in claims 1, wherein a material of construction for the package holding and the package fixing provision is selected from one or more biodegradable materials including cardboard, plastic, and polymer based material.

7. A child safe packaged-product system with multi-operational access control system as claimed in claims 1, wherein the package is provided with an identification tag for identifying the package for authentication wherein the tag comprises at least two sets of identification information, the at least two sets of identification information comprising a first set of identification information, and a second set of identification information each arranged within a different surface, side or plane of the identification tag, and identification features of the first set of identification information and identification features of the second set of identification information are arranged at a fixed relative spatial position with respect to each other, the fixed spatial relationship being used for identifying the packaged-product system.

8. A child safe packaged-product system with multi-operational access control system as claimed in claim 7 wherein one or more identifiers are present in a tag on the product package wherein a first identifier comprises a readable layer of randomly distributed material which is capable of encoding identification information including one or more of a conductive material, magnetized or magnetizable material, semiconductive particle and optically active particles, and a second identifier comprises optical information, including a 1-D or 2-D bar code.

9. A child safe packaged-product system with multi-operational access control system as claimed in claim 2, wherein the sensor comprises of signal generating one or more provisions including a data processor, a data storage configured with a communication device, an optional communication switch, a power source, optional audio signal generator, and an oscillator, wherein the signal generating means gets activated upon disengaging the package from the package holding provision to detect disengagement of the package from the package holding provision to monitor and/or record of package and for product access from the package system, wherein the activation of the signal generating provision is done electronically, mechanically, optically, or visually.

10. A child safe packaged-product system with multi-operational access control system as claimed in claim 9, wherein upon disengagement of the package from the holding provision, a signal from the signal generating provision is sent to the data processor wherein a time & date of product dispensed is logged into the data logging provision of the data processor, wherein the logged data in the data processing is transferred/transmitted via communication device to one or more external device with the aid of RF, IR link, wired and/or any direct contact methods including I2C, SPI, and serial or parallel communication.

11. A child safe packaged-product system with multi-operational access control system as claimed in claim 1, wherein the package holding provision is operably connected to a package fixing provision that is in the form of a frame like structure adapted to fit a package in it wherein the frame like structure comprises of stripes integrated with each other and disposed around the edges of the package so as to hold the package wherein the stripes on the surface facing the base of the package holding provision are provided with one or more pegs with a profiled surface comprising one or plurality of projections that facilitates interference fit and disengagement of the peg in at least two steps wherein the lamina is provided with corresponding engagement provision for the one or more pegs.

12. A child safe packaged-product system with multi-operational access control system as claimed in claim wherein the system comprises a package in the form of a blister provided with perforation lines between the product containments, the blister is adapted to attach to the package holding provision comprising the lamina provided with a bonding material disposed on the lamina so as to hold/attach the package; the lamina is adapted to removably receive a snap, wherein the lamina is operably connected to the frame like structure comprising of stripes integrated with each other and disposed along the side of the package; the structure is provided with a snap; the stripes of the frame like structure on the surface facing the lamina are provided with one or more pegs with a profiled surface comprising one or plurality of projections that facilitates interference fit and disengagement of the one or more pegs in at least two steps wherein the lamina is provided with corresponding engagement provision for the one or more pegs.

13. A child safe packaged-product system with multi-operational access control system as claimed in claim 1, wherein the package holding provision is adapted to fit a reader to identify and read an unique identification information on the package wherein the reader is suitably able to detect the identification information relating to the product package and conveys the information or generates a signal in response to the information which is communicable to the external device.

14. A child safe packaged-product system with multi-operational access control system as claimed in claim 1, wherein to access the product, user has to reciprocate the protruding reciprocable member and simultaneously press the pressable member to partially disengage the package from the package holding provision to complete child resistant activity, further the user has to perform a second activity to decouple or disengage the assembly of package and package fixing provision that is operably coupled or engaged by the restriction with the lamina of the package holding provision to access the package.

* * * * *